United States Patent [19]

Akashi et al.

[11] Patent Number: 4,667,377

[45] Date of Patent: May 26, 1987

[54] SLIDE FASTENER WITH A PAIR OF INTERMESHABLE TOP ENDS STOPS

[75] Inventors: Syunji Akashi, Kurobe; Kenji Yuuki, Toyama, both of Japan

[73] Assignee: Yoshida Kogyo K. K., Tokyo, Japan

[21] Appl. No.: 808,484

[22] Filed: Dec. 13, 1985

[30] Foreign Application Priority Data

Dec. 15, 1984 [JP] Japan ..... 59-190461[U]

[51] Int. Cl.[4] ..... A44B 19/36

[52] U.S. Cl. ..... 24/436; 24/419; 24/429; 24/437

[58] Field of Search ..... 24/436, 429, 419, 430, 24/437

[56] References Cited

U.S. PATENT DOCUMENTS

| | | | |
|---|---|---|---|
| 1,910,404 | 5/1933 | Prentice | 24/436 |
| 1,910,953 | 5/1933 | Johnson | 24/436 |
| 2,422,091 | 6/1947 | Gould | 24/436 |
| 3,862,474 | 1/1975 | Ebata | 24/436 |
| 4,023,241 | 5/1977 | Kanzaka | 24/436 |
| 4,109,349 | 8/1978 | Tanaka | 24/436 |

FOREIGN PATENT DOCUMENTS

| | | | |
|---|---|---|---|
| 2904221 | 8/1979 | Fed. Rep. of Germany | 24/436 |
| 706794 | 4/1954 | United Kingdom | 24/436 |

*Primary Examiner*—Victor N. Sakran

*Attorney, Agent, or Firm*—Hill, Van Santen, Steadman & Simpson

[57] ABSTRACT

A slide fastener having a top stop assembly including a pair of top end stops which are meshable with each other so as to make the total width of the top stop assembly slightly smaller than the minimum width of a Y-shaped guide channel of a slider for allowing the top stop assembly to pass through the guide channel. The two top end stops have at their inner sides a pair of mating stepped portions complementary in shape to each other. The top stop assembly also includes blocking means for being attached to at least one of the mating stepped portions to prevent the two top end stops from meshing with each other.

2 Claims, 14 Drawing Figures

SLIDE FASTENER WITH A PAIR OF INTERMESHABLE TOP ENDS STOPS

BACKGROUND OF THE INVENTION

1. Field of the Invention

The present invention relates to the production of slide fasteners, and more particularly to a slide fastener having a pair of intermeshable top end stops.

2. Description of Prior Art

In the manufacture of slide fasteners, it has been a known practice to thread individual sliders one after another onto a continuous slide fastener chain to which a plurality of pairs of top end stops and a plurality of bottom end stops (or separable bottom stop assemblies) have been attached beforehand. To this end, various types of top stop assemblies have been proposed which allow a slider to be moved past the top end stops during the threading and which then prevent the slider from being moved past the same top end stops after the threading.

One example of such top stop assemblies, as disclosed in Japanese Utility Model Post-Examination Publication (Jikkosho) No. 46-6577 and reillustrated in FIG. 7 of the accompanying drawings, comprises a pair of top end stops 1, 2 each having a guide recess 3, 4 extending from its upper end and terminating short of its lower end. Both the width and the depth of the recess 3, 4 decrease gradually from the upper end to the lower end of the individual top end stop 1, 2. This recess 3, 4 thus serves as a one-way path for one of opposite side flanges 5, 6 of a slider 7; the two top end stops 1, 2 resiliently deform when the side flanges 5, 6 of the slider 7 are forced past these top end stops 1, 2 during the threading. The major problem with this prior art construction, however, is that the top end stops 1, 2 as well as the slider 7 are apt to be unrecoverably deformed or damaged. Further, since the top end stops 1, 2 cannot enter the slider 7 when the latter is pulled to close the slide fastener all the way after the slider 7 has been threaded onto a pair of fastener element rows, this known slide fastener was found to be not neat in appearance.

SUMMARY OF THE INVENTION

According to the present invention, a slide fastener has a top stop assembly including a pair of top end stops which are meshable with each other so as to make the total width of the top stop assembly slightly smaller than the minimum width of a Y-shaped guide channel of a slider for allowing the top stop assembly to pass through the guide channel. The two top end stops have at their inner sides a pair of mating stepped portions complementary in shape to each other. The top stop assembly also includes blocking means for being attached to at least one of the mating stepped portions to prevent the two top end stops from meshing with each other.

It is therefore an object of the present invention to provide a slide fastener having a pair of top end stops which are intermeshable so that a slider can be threaded onto a pair of fastener stringers easily without any deformation of either the top end stops or the slider.

Another object of the invention is to provide a slide fastener having a pair of top end stops which can enter a slider thoroughly when the latter is pulled all the way upwardly or forwardly to close the slide fastener, thus making the slide fastener neat in appearance.

Many other objects, advantages and additional features of the present invention will become manifest to those versed in the art upon making reference to the detailed description and the accompanying sheets of drawings in which two preferred structural embodiments incorporating the principles of the present invention are shown by way of illustrative example.

DETAILED DESCRIPTION

Figure 1A:
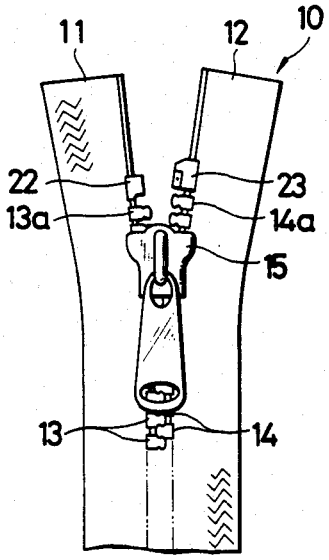
FIG. 1A is a fragmentary plan view of a slide fastener having a pair of mating top end stops embodying the present invention.

The present invention is particularly useful when embodied in a slide fastener such as shown in FIG. 1A, generally indicated by the numeral 10.

The slide fastener 10 generally comprises a pair of fastener stringers including a pair of stringer tapes 11, 12 and a pair of rows of fastener elements 13, 14 mounted on the stringer tapes 11, 12 along their respective inner longitudinal edges, and a slider 15 threaded onto the pair of fastener stringers for movement along the pair of rows of fastener elements 13, 14 to close and open the slide fastener 10. A bottom end stop (not shown) is mounted on the pair of stringers at the lower end of the fastener element rows 13, 14 for limiting backward or downward movement of the slider 15. At the upper end of the fastener element rows 13, 14, a top stop assembly, which is described below in detail, is mounted for limiting forward or upward movement of the slider 15.

As shown in FIGS. 5A–5C and 6A–6C, the slider 15 includes a slider body having a wedge-shaped neck portion 17 disposed centrally at a flared front end 18 thereof and a pair of first and second flaring flanges 19, 20 disposed along opposite sides of the slider 15 to define with the neck portion 17 a Y-shaped guide channel 21 for passage of the top stop assembly (as described below) as well as the fastener element rows 13, 14.

Figure 2A:
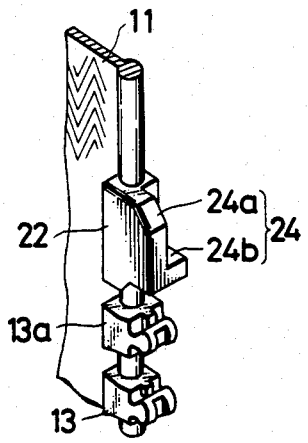
FIG. 2A is an enlarged, fragmentary perspective view of FIG. 1A, showing one fastener stringer on which one of the mating top end stops is mounted.
Figure 2B:
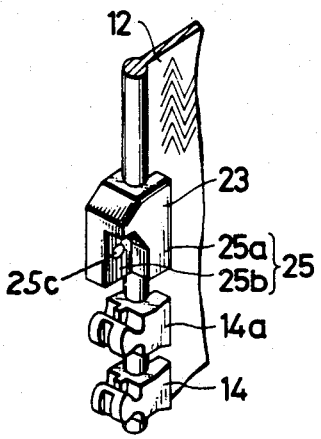
FIG. 2B is a view similar to FIG. 2A, showing the other fastener stringer on which the other top end stop is mounted.
Figure 3A:
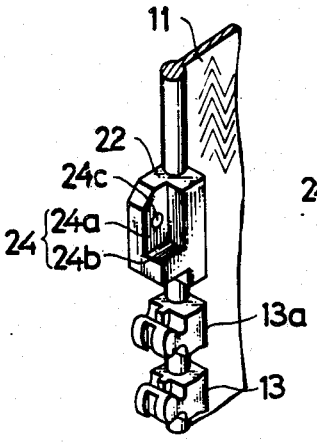
FIGS. 3A and 3B illustrate the manner in which a blocking piece is attached to one of the mating top end stops.
Figure 3B:
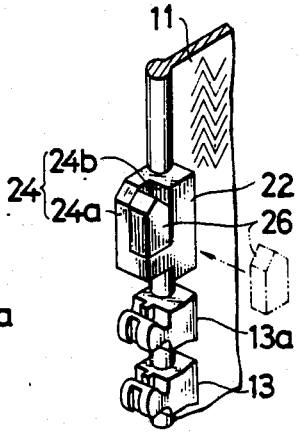
Figure 4:
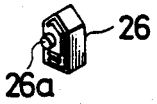
FIG. 4 is a perspective view of the blocking piece of FIG. 3B.

The top stop assembly, as better shown in FIGS. 1A, 2A and 2B, includes a first top end stop 22 mounted on the inner longitudinal edge of one of the fastener tapes 11 adjacent to the uppermost fastener element **13*a*, and a second top end stop 23 mounted on the inner longitudinal edge of the other fastener tape 12 adjacent to the upper most fastener element 14*a* and meshable with the first top end stop 22 so as to make the total width D (FIG. 5A) of the top stop assembly slightly smaller than the minimum width d of the guide channel 21 for allowing the top stop assembly to pass therethrough without any deformation of either the slider 15 or these top end stops 22, 23** during the threading.

Figure 5A:
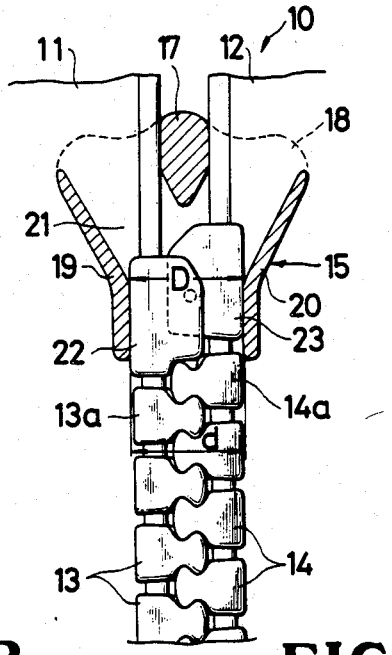
FIGS. 5A, 5B and 5C are fragmentary plan views, partially in cross section, illustrating the mode of operation of the mating top end stops.

The first and second top end stops 22, 23 have at their inner sides a pair of mating stepped portions 24, 25 complementary in shape to each other, each stepped portion 24, 25 defining a projection 24*a*, 25*a* and a recess 24*b*, 25*b* which is receptive of each other's projection 25*a*, 24*a*, as shown in FIG. 5A.

The top stop assembly also includes a blocking means for being attached to one of the mating stepped portions 24, 25 to close the corresponding recess 24*b*, 25*b*, thus preventing the first and second top end stops 22, 23 from meshing with each other. As shown in FIGS. 1A, 3B, 4 and 5C, the blocking means is in the form of a piece of rigid and solid material 26 having a tongue 26*a*. The stepped portion 24, 25 of each top end stop 22, 23 has a blind hole 24*c*, 25*c* for receiving the tongue 26*a* when the blocking piece 26 is attached to the stepped portion 24, 25. In attaching the blocking piece 26, the tongue 26*a* and the corresponding hole 24*c*, 25*c* jointly serve to assist in placing the blocking piece 26 in correct position at the stepped portion 24, 25.

Figure 1B:
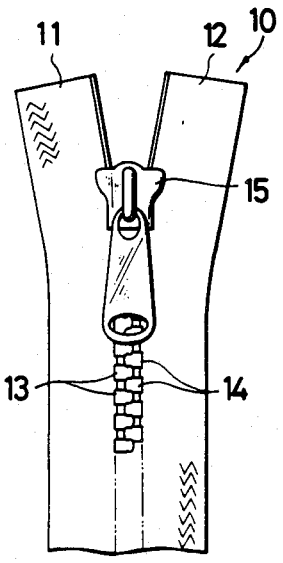
FIG. 1B is a view similar to FIG. 1A, showing the slide fastener having been fully closed.
Figure 7:
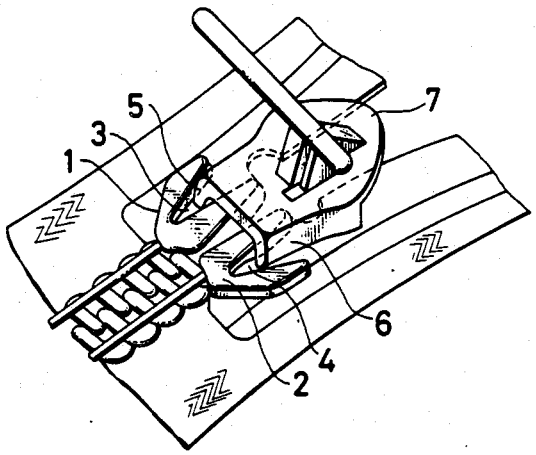
FIG. 7 (PRIOR ART)
FIG. 7, appearing with FIGS. 1A and 1B, is a fragmentary perspective view of a prior art slide fastener.
Figure 5B:
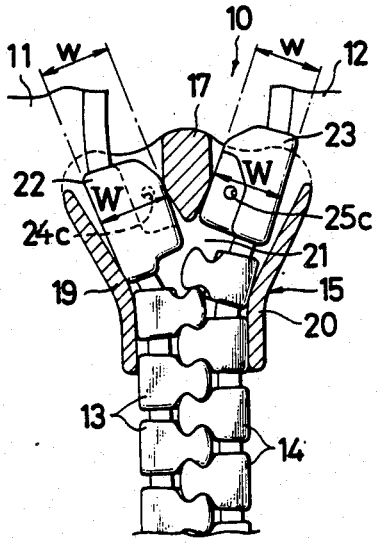
Figure 5C:
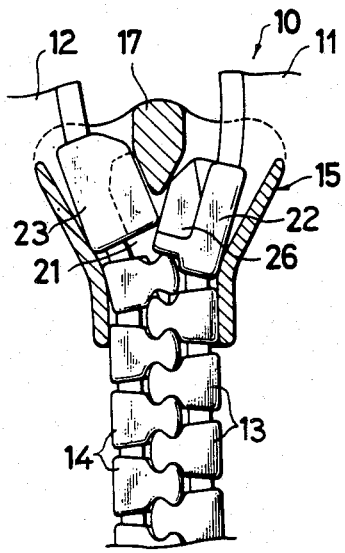

Each top end stop 22, 23 has a width W (FIG. 5B) smaller than the minimum distance w between the neck portion 17 and the corresponding flaring side flange 19, 20 of the slider 15 so that the two top end stops 22, 23, even with the blocking piece 26 attached to one of them, can enter the slider 15 thoroughly (FIG. 5C) when the latter is pulled all the way to close the slide fastener 10, thus making the slide fastener 10 neat in appearance, as shown in FIG. 1B. (FIG. 5C is drawn inverted from FIGS. 5A and 5B.)

In assembly, the pair of fastener stringers of FIGS. 2A and 2B are coupled together, at which time the first and second top end stops 22, 23 as well as the pair of fastener element rows 13, 14 are intermeshed respectively. The thus coupled fastener stringers are then threaded through the slider 15 from their top end, as shown in FIGS. 5A and 5B, until the slider 15 is moved past the top end stops 22, 23 as shown in FIG. 1A. Finally, the blocking piece 26 is attached to the stepped portion 24 of the first top end stop 22 to thereby prevent the latter from meshing with the second top end stop 23. As a result, the two top end stops 22, 23 can no longer pass through the narrow end of the Y-shaped guide channel 21 of the slider 15, as shown in FIG. 5C, when the latter is pulled all the way upwardly or forwardly to close the slide fastener 10, but these two top end stops 22, 23 can only enter the slider 15 thoroughly and then cannot be observed from outside.

Figure 6A:
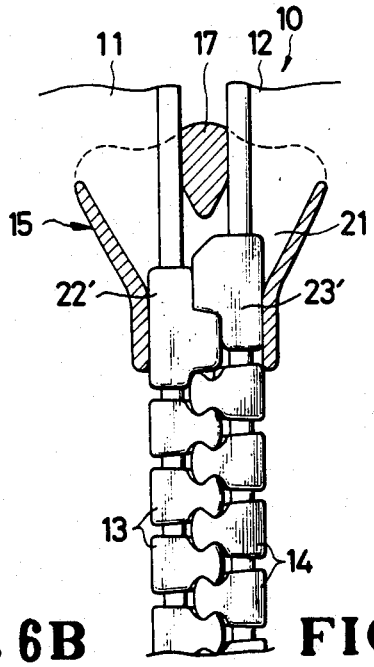
FIGS. 6A, 6B and 6C are views similar to FIGS. 5A, 5B and 5C, illustrating a modification of the mating top end stops.
Figure 6B:
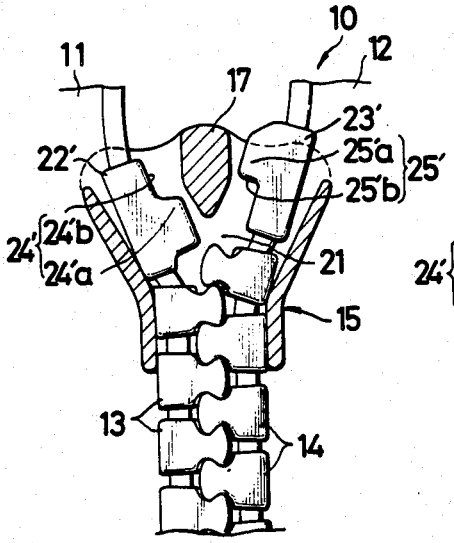
Figure 6C:
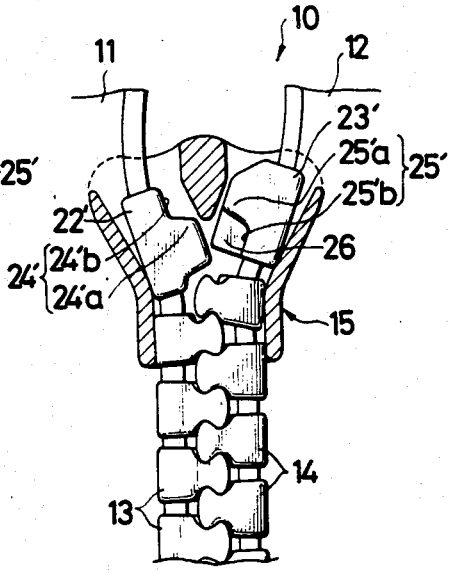

FIGS. 6A, 6B and 6C illustrate a second embodiment in which the first and second top end stops 22', 23' have a pair of modified mating stepped portions 24', 25'. The first top end stop 22' has at its upper inner portion a recess 24*b*' receptive of a projection 25*a*' extending from the corresponding portion of the second top end stop 23', while the second top end stop 23' has at its lower inner portion a recess 25*b*' receptive of a projection 24*a*' extending from the corresponding portion of the first top end stop 22'. Thus these two top end stops 22', 23' can mesh with each other so as to become shrunk in total width so that the slider 15 can be moved past the two top end stops 22', 23' without any deformation of either the slider 15 or the top end stops 22', 23' during the threading, as shown in FIGS. 6A and 6B. If a blocking piece 26 of rigid and solid material is attached, by bonding for example, to the stepped portion 25' of at least one of the two top end stops 22' after the threading, the two top end stops 22', 23' are then prevented from meshing with each other and hence can no longer pass through the narrow end of the Y-shaped guide channel 21 of the slider 15. And these two top end stops 22', 23' can enter the slider 15 entirely when the latter is pulled all the way upwardly or forwardly to close the slide fastener 10, as shown in FIG. 6C.

Although various minor modifications may be suggested by those versed in the art, it should be understood that we wish to embody within the scope of the patent warranted hereon, all such embodiments as reasonable and properly come within the scope of our contribution to the art.

What is claimed is:

1. A slide fastener comprising:

(a) a pair of stringer tapes;

(b) a pair of rows of fastener elements mounted on said stringer tapes along respective inner longitudinal edges thereof;

(c) a slider threaded onto said pair of rows of fastener elements for movement therealong to close and open the slide fastener, said slider including a slider body having a neck portion disposed centrally at a flared front end thereof and a pair of first and second flaring flanges disposed along opposite sides of said slider so as to define with said neck portion a Y-shaped guide channel for passage of said pair of rows of fastener elements;

(d) a bottom stop mounted on said inner longitudinal edges of said stringer tapes adjacent to the lowermost fastener element for limiting backward movement of said slider; and (e) a top stop assembly for limiting forward movement of said slider, said assembly including (1) a first top end stop mounted on said inner longitudinal edge of one of said stringer tapes adjacent to the uppermost fastener element, (2) a second top end stop mounted on said inner longitudinal edge of the other stringer tape adjacent to the uppermost fastener element, said first and second top end stops having a pair of mating stepped portions at their respective inner sides, said stepped portions of each of said first and second top end stops defining a projection and a recess receptive of each other's projection; said first and second top end stops being thereby intermeshable with each other so as to make the total width of said top stop assembly slightly smaller than the minimum width of said guide channel of said slider for allowing said top stop assembly to pass through said guide channel, and (3) at least one blocking piece of rigid material for being attached to at least one of said mating stepped portions to close said recess in at least one of said first and second top end stops for preventing said first and second top end stops from meshing with each other.

2. A slide fastener according to claim 1, at least one of said mating stepped portions having a hole opening to said recess, said piece of rigid material having a tongue for being received in said hole when said piece is attached to said one stepped portion.

* * * * *